US009728893B1

(12) United States Patent
Lou et al.

(10) Patent No.: US 9,728,893 B1
(45) Date of Patent: Aug. 8, 2017

(54) PLUG CONNECTOR AND TERMINAL APPLIED THERETO

(71) Applicant: Cheng Uei Precision Industry Co., Ltd., New Taipei (TW)

(72) Inventors: Fang Jin Lou, Dong-Guan (CN); Bo Liu, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/394,698

(22) Filed: Dec. 29, 2016

(51) Int. Cl.

| | |
|---|---|
| ***H01R 9/05*** | (2006.01) |
| ***H01R 13/627*** | (2006.01) |
| ***H01R 13/405*** | (2006.01) |
| ***H01R 13/50*** | (2006.01) |

(52) U.S. Cl.
CPC ..... *H01R 13/6277* (2013.01); *H01R 13/405* (2013.01); *H01R 13/50* (2013.01)

(58) Field of Classification Search
CPC .... H01R 17/12; H01R 17/125; H01R 23/722; H01R 13/2442
USPC ..... 439/345, 578, 63, 591, 862
See application file for complete search history.

(56) References Cited

U.S. PATENT DOCUMENTS

| | | | | |
|---|---|---|---|---|
| 9,509,106 | B2 * | 11/2016 | Nakamura | H01R 24/50 |
| 2008/0299835 | A1 * | 12/2008 | Lin | H01R 24/58 439/668 |
| 2013/0115810 | A1 * | 5/2013 | Maruyama | H01R 24/38 439/578 |
| 2013/0225008 | A1 * | 8/2013 | Liu | H01R 24/58 439/676 |

* cited by examiner

*Primary Examiner* — Phuongchi T Nguyen
(74) *Attorney, Agent, or Firm* — Cheng-Ju Chiang

(57) ABSTRACT

A plug connector includes an insulating housing, and a terminal surrounding the insulating housing. The insulating housing has a fastening portion. Two opposite sides of a top of the fastening portion protrude upward and are arched outward to form two fastening pieces. A fastening slot is formed among a lateral wall, an inner wall and a bottom wall of the terminal. Two portions of a top surface of the lateral wall protrude upward to form two insertion portions. The fastening portion is fastened in the fastening slot. One of the two insertion portions is located between one side of one of the two fastening pieces and one side of the other fastening piece. The other insertion portion is located between the other side of the one of the two fastening pieces and the other side of the other fastening piece.

16 Claims, 7 Drawing Sheets

PLUG CONNECTOR AND TERMINAL APPLIED THERETO

BACKGROUND OF THE INVENTION

1. Field of the Invention

The present invention generally relates to a connector, and more particularly to a plug connector and a terminal applied thereto.

2. The Related Art

A conventional plug connector generally includes an insulating housing and a terminal. The terminal is fastened in the insulating housing. The terminal has an insertion portion. The insertion portion projects out of the insulating housing. However, the insulating housing surrounds the terminal that makes the insulating housing be easily scratched in the process of the terminal being fastened in the insulating housing, so the conventional plug connector is incapable of satisfying a high-demanding appearance standard.

Thus, whether the above-mentioned problem is solved by virtue of designing an innovative plug connector has become an important issue which is to be solved by skilled persons in the art, so the innovative plug connector capable of effectively improving the above-mentioned problem is needed to be provided.

SUMMARY OF THE INVENTION

An object of the present invention is to provide a plug connector. The plug connector includes an insulating housing and a terminal. The insulating housing has an annular fastening portion. Two opposite sides of a top of the fastening portion protrude upward and are arched outward to form two spaced arc-shaped fastening pieces. The terminal surrounds the insulating housing. The terminal has a substantially annular lateral wall, a substantially annular inner wall located inside and spaced from the lateral wall, and a substantially annular bottom wall connected between bottoms of the lateral wall and the inner wall. A substantially annular fastening slot is formed among the lateral wall, the inner wall and the bottom wall. Two portions of a top surface of the lateral wall protrude upward to form two insertion portions spaced from each other. The fastening portion is fastened in the fastening slot. One of the two insertion portions is located between one side of one of the two fastening pieces and one side of the other fastening piece. The other insertion portion is located between the other side of the one of the two fastening pieces and the other side of the other fastening piece.

Another object of the present invention is to provide a terminal applied to a plug connector. The terminal includes a first semicircular portion and a second semicircular portion facing each other and shown as a substantially annular shape. The terminal includes a substantially annular lateral wall, a substantially annular inner wall located inside and spaced from the lateral wall, and a substantially annular bottom wall connected between bottoms of the lateral wall and the inner wall. A substantially annular fastening slot is formed among the lateral wall, the inner wall and the bottom wall. Two insertion portions are protruded upward from top surfaces of a first lateral wall of the first semicircular portion and a second lateral wall of the second semicircular portion, respectively.

As described above, the fastening portion of the insulating housing is fastened in the fastening slot of the terminal, so the insulating housing is without being scratched in the process of the insulating housing being fastened in the terminal, so the plug connector is capable of satisfying a high-demanding appearance standard.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

With reference to FIG. 1 to FIG. 5, a plug connector 100 in accordance with a preferred embodiment of the present invention is shown. The plug connector 100 includes an insulating housing 10 and a terminal 20.

Figure 1:
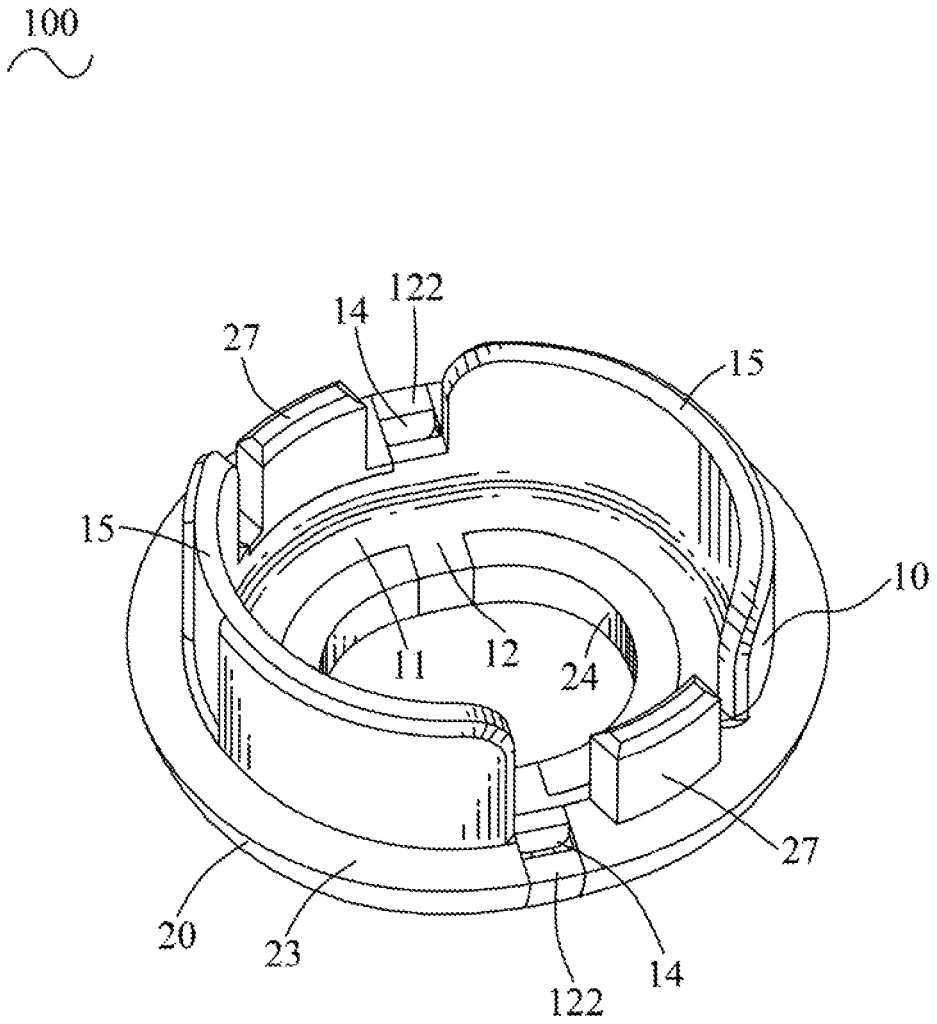
FIG. 1 is a perspective view of a plug connector in accordance with a preferred embodiment of the present invention.
Figure 2:
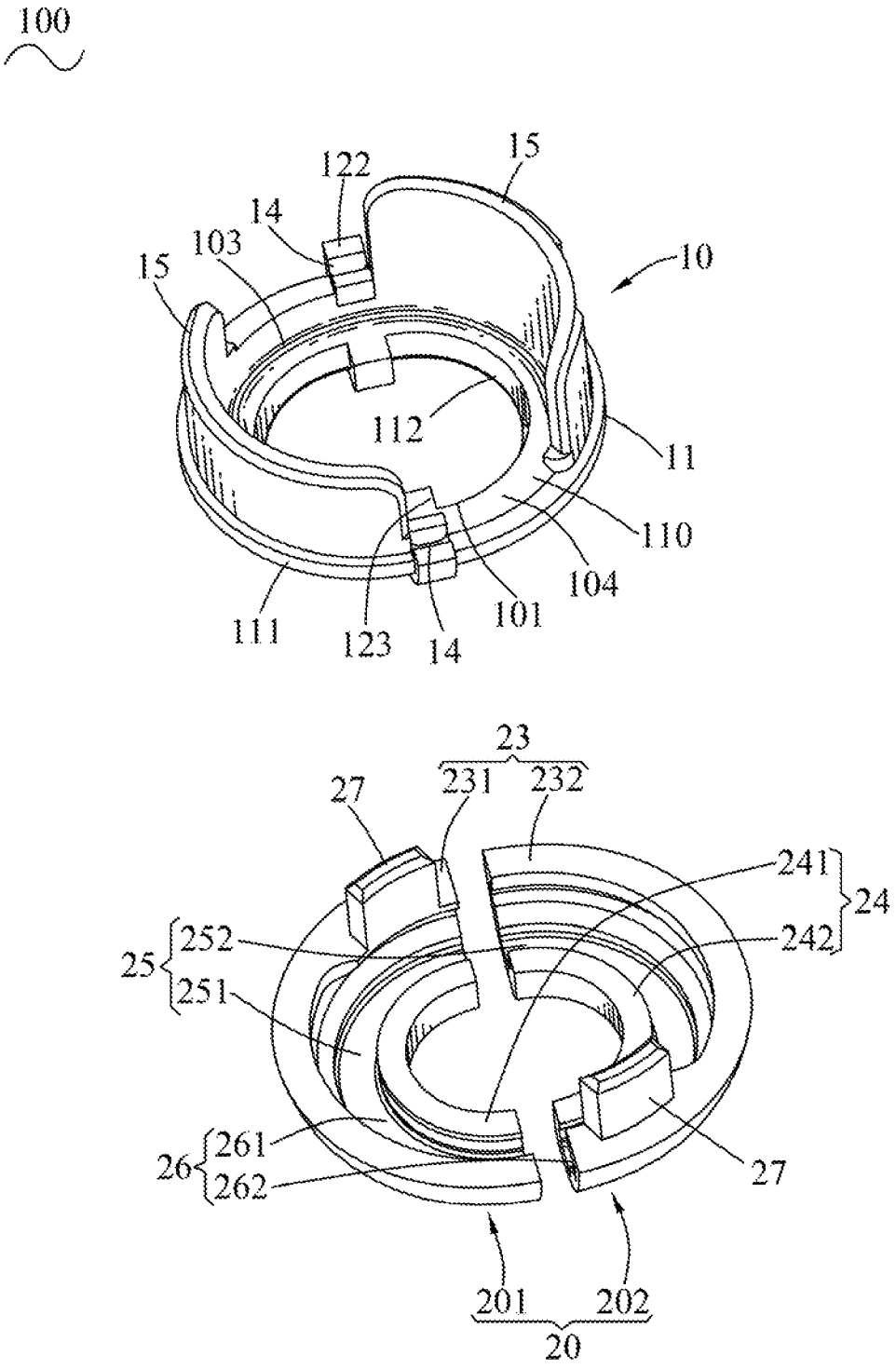
FIG. 2 is an exploded perspective view of the plug connector of FIG. 1.
Figure 3:
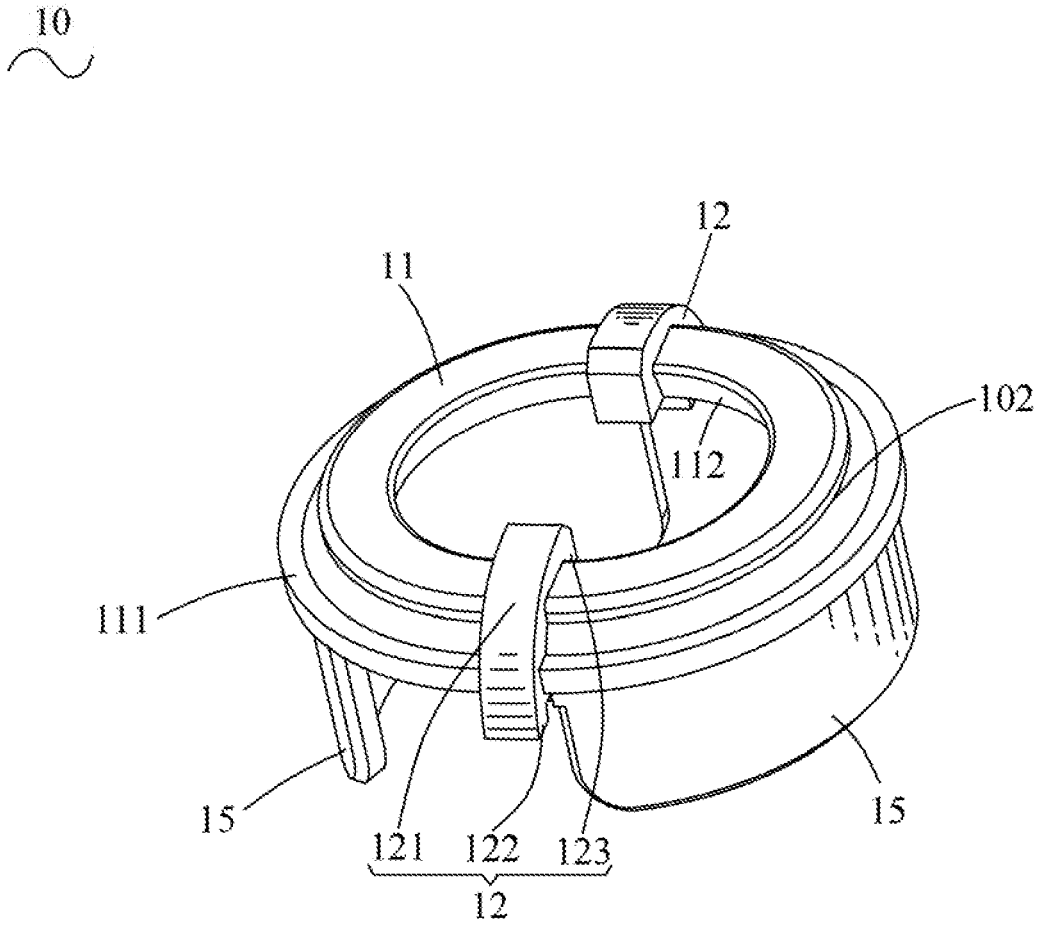
FIG. 3 is a perspective view of an insulating housing of the plug connector of FIG. 2.
Figure 4:
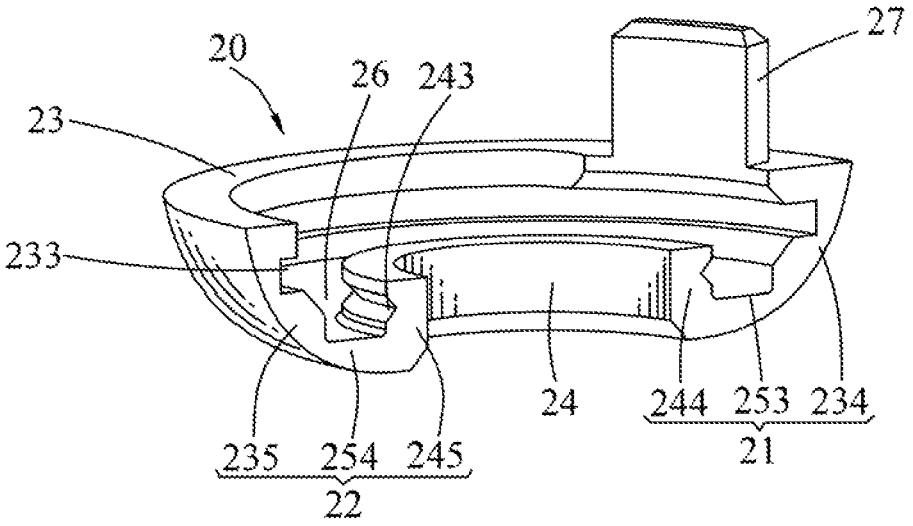
FIG. 4 is a partially perspective view of a terminal of the plug connector of FIG. 2.
Figure 5:
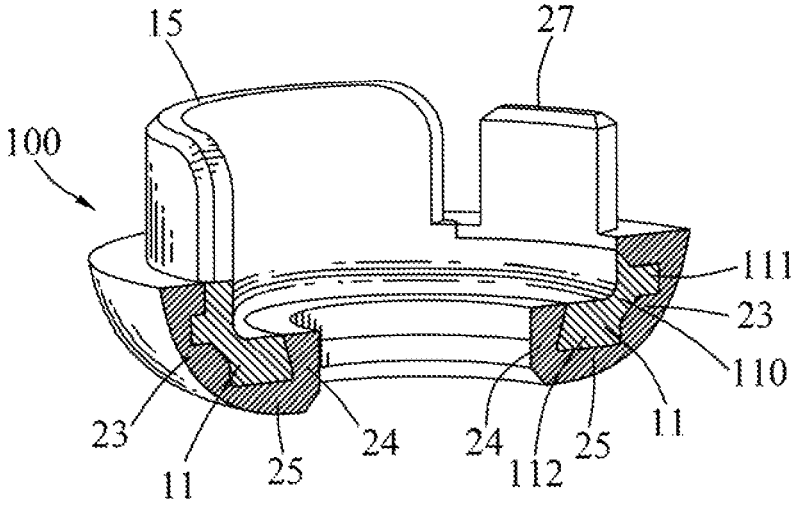
FIG. 5 is a sectional perspective view of the plug connector of FIG. 1.
Figure 6:
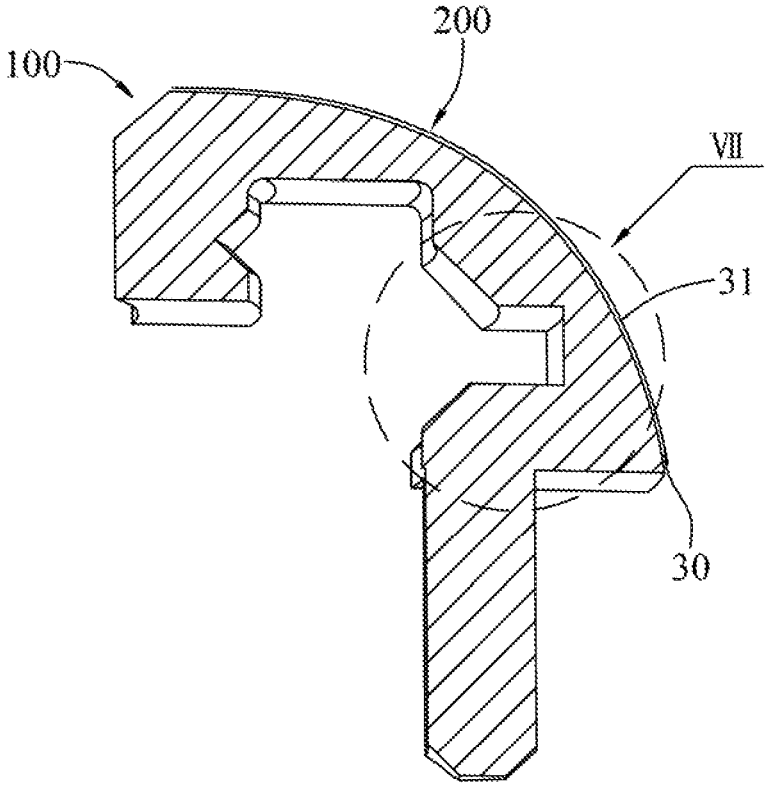
FIG. 6 is a schematic diagram of the plug connector in accordance with the preferred embodiment of the present invention being molded in a mold.
Figure 7:
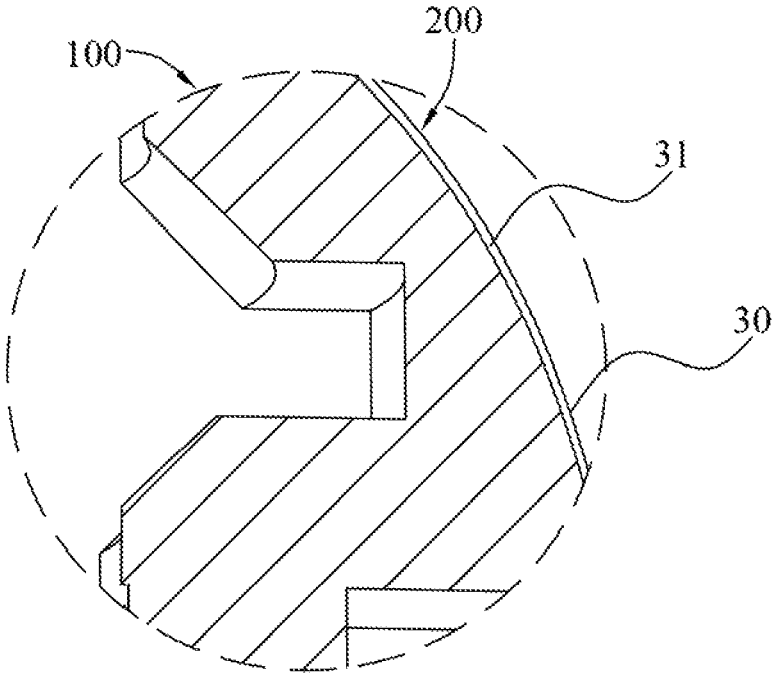
FIG. 7 is an enlarged view of an encircled portion VII of the plug connector of FIG. 6.

Referring to FIG. 2 and FIG. 3, the insulating housing 10 is an integrative element. The insulating housing 10 has an annular fastening portion 11. The fastening portion 11 has an annular base portion 110. The base portion 110 has a top edge 101, and a bottom edge 102 opposite to the top edge 101. The base portion 110 has a ring-shaped inner surface 103 and a ring-shaped outer surface 104 connected between the top edge 101 and the bottom edge 102 of the base portion 110. A middle of the outer surface 104 of the base portion 110 is arched outward away from a center of the base portion 110.

The middle of the outer surface 104 of the base portion 110 protrudes outward away from the center of the base portion 110 to form a ring-shaped fixing rib 111. The inner surface 103 of the base portion 110 protrudes inward towards the center of the base portion 110 and then extends downward to form a ring-shaped restricting block 112 connected with the bottom edge 102 of the base portion 110. Two opposite sides of the fastening portion 11 are connected with two half-surrounded fastening blocks 12, respectively. An outer surface of each of the two fastening blocks 12 is arched outward and is shown as an arc shape.

Each of the two fastening blocks 12 includes a first fastening block 121, a second fastening block 122 and a third fastening block 123. Outer peripheries of the two opposite sides of the fastening portion 11 protrude outward to form two first fastening blocks 121 of the two fastening blocks 12, respectively. Two opposite sides of a top of the fastening portion 11 protrude upward and outward to form two second fastening blocks 122 of the two fastening blocks 12, respectively. The two second fastening blocks 122 of the two fastening blocks 12 are connected with tops of the two first fastening blocks 121, respectively. A top of each of the two second fastening blocks 122 is recessed downward to form a recess 14. Lower ends of the first fastening blocks 121 are bent upward and connected with an inner surface of the fastening portion 11 to form two third fastening blocks 123 of the two fastening blocks 12, respectively.

The two opposite sides of the top of the fastening portion 11 protrude upward and are arched outward to form two spaced arc-shaped fastening pieces 15. Inner surfaces of the two fastening pieces 15 are consistent with the inner surface 103 of the base portion 110. One of the two second fastening blocks 122 is located between the two fastening pieces 15 and adjacent to one of the two fastening pieces 15. The other second fastening block 122 is located between the two fastening pieces 15 and adjacent to the other fastening piece 15.

Referring to FIG. 1 to FIG. 4, the terminal 20 is applied to the plug connector 100. The terminal 20 surrounds the insulating housing 10. The terminal 20 includes a first semicircular portion 201 and a second semicircular portion 202. The first semicircular portion 201 and the second semicircular portion 202 are assembled to two opposite sides of the insulating housing 10, respectively. The first semicircular portion 201 and the second semicircular portion 202 face each other and are shown as a substantially annular shape. The two fastening blocks 12 are clamped between the first semicircular portion 201 and the second semicircular portion 202. Two end surfaces of each of the first semicircular portion 201 and the second semicircular portion 202 are defined as a first truncation surface 21 and a second truncation surface 22, respectively.

The two first truncation surfaces 21 of the first semicircular portion 201 and the second semicircular portion 202 face each other. The two second truncation surfaces 22 of the first semicircular portion 201 and the second semicircular portion 202 face each other. The two first truncation surfaces 21 of the first semicircular portion 201 and the second semicircular portion 202 abut against two opposite surfaces of one of the two fastening blocks 12, respectively. The two second truncation surfaces 22 of the first semicircular portion 201 and the second semicircular portion 202 abut against two opposite surfaces of the other fastening block 12, respectively.

The terminal 20 has a substantially annular lateral wall 23, a substantially annular inner wall 24 located inside and spaced from the lateral wall 23, and a substantially annular bottom wall 25 connected between bottoms of the lateral wall 23 and the inner wall 24. A substantially annular fastening slot 26 is formed among the lateral wall 23, the inner wall 24 and the bottom wall 25. Two portions of a top surface of the lateral wall 23 protrude upward to form two insertion portions 27 spaced from each other.

Specifically, the first semicircular portion 201 has a semicircular first lateral wall 231, a semicircular first inner wall 241 located inside and spaced from the first lateral wall 231, and a semicircular first bottom wall 251 connected between bottoms of the first lateral wall 231 and the first inner wall 241. A semicircular first fastening slot 261 is formed among the first lateral wall 231, the first inner wall 241 and the first bottom wall 251. The second semicircular portion 202 has a semicircular second lateral wall 232, a semicircular second inner wall 242 located inside and spaced from the second lateral wall 232, and a semicircular second bottom wall 252 connected between bottoms of the second lateral wall 232 and the second inner wall 242. A semicircular second fastening slot 262 is formed among the second lateral wall 232, the second inner wall 242 and the second bottom wall 252.

Two end surfaces of each of the first lateral wall 231 and the second lateral wall 232 are defined as a first abutting surface 234 and a fourth abutting surface 235, respectively. Two end surfaces of each of the first inner wall 241 and the second inner wall 242 are defined as a second abutting surface 244 and a fifth abutting surface 245, respectively. Two end surfaces of each of the first bottom wall 251 and the second bottom wall 252 are defined as a third abutting surface 253 and a sixth abutting surface 254, respectively. The two first abutting surfaces 234 of the first lateral wall 231 and the second lateral wall 232 face each other. The two fourth abutting surfaces 235 of the first lateral wall 231 and the second lateral wall 232 face each other. The two second abutting surfaces 244 of the first inner wall 241 and the second inner wall 242 face each other. The two fifth abutting surfaces 245 of the first inner wall 241 and the second inner wall 242 face each other. The two third abutting surfaces 253 of the first bottom wall 251 and the second bottom wall 252 face each other. The two sixth abutting surfaces 254 of the first bottom wall 251 and the second bottom wall 252 face each other.

The first truncation surface 21 of the first semicircular portion 201 includes the first abutting surface 234 of the first lateral wall 231, the second abutting surface 244 of the first inner wall 241 and the third abutting surface 253 of the first bottom wall 251. The first truncation surface 21 of the second semicircular portion 202 includes the first abutting surface 234 of the second lateral wall 232, the second abutting surface 244 of the second inner wall 242 and the third abutting surface 253 of the second bottom wall 252. The second truncation surface 22 of the first semicircular portion 201 includes the fourth abutting surface 235 of the first lateral wall 231, the fifth abutting surface 245 of the first inner wall 241 and the sixth abutting surface 254 of the first bottom wall 251. The second truncation surface 22 of the second semicircular portion 202 includes the fourth abutting surface 235 of the second lateral wall 232, the fifth abutting surface 245 of the second inner wall 242 and the sixth abutting surface 254 of the second bottom wall 252.

The lateral wall 23 includes the first lateral wall 231 and the second lateral wall 232. The inner wall 24 includes the first inner wall 241 and the second inner wall 242. The bottom wall 25 includes the first bottom wall 251 and the second bottom wall 252. The fastening slot 26 includes the first fastening slot 261 and the second fastening slot 262. The two insertion portions 27 are protruded upward from top surfaces of the first lateral wall 231 of the first semicircular portion 201 and the second lateral wall 232 of the second semicircular portion 202, respectively. The one of the two second fastening blocks 122 is located between the one of the two fastening pieces 15 adjacent to the one of the two second fastening blocks 122, and one of the two insertion portions 27. The other second fastening block 122 is located between the other fastening piece 15 adjacent to the other second fastening block 122, and the other insertion portion 27. An outer surface of the inner wall 24 is recessed inward towards a center of the terminal 20 to form a substantially ring-shaped restricting slot 243. An inner surface of lateral wall 23 is recessed in a direction away from the center of the terminal 20 to form a substantially ring-shaped fixing slot 233.

Referring to FIG. 1 to FIG. 7, the terminal 20 of the plug connector 100 is positioned in a cavity 30 of a mold 200. The insulating housing 10 is integrally molded in the terminal 20. A gap 31 between an inner surface of the cavity 30 of the mold 200 and an outer surface of the plug connector 100 is 0.02 mm. The fastening portion 11 is fastened in and integrally molded in the fastening slot 26. The fixing rib 111 is fixed in the fixing slot 233. The restricting block 112 is restricted in the restricting slot 243.

Upper portions of the two first fastening blocks 121 are clamped between lower portions of the first lateral wall 231 and the second lateral wall 232, respectively. Lower portions of the two first fastening blocks 121 are clamped between the first bottom wall 251 and the second bottom wall 252, respectively. Lower portions of the two first abutting surfaces 234 of the first lateral wall 231 and the second lateral wall 232 abut against upper portions of two opposite side surfaces of one of the two first fastening blocks 121, respectively. Lower portions of the two fourth abutting surfaces 235 of the first lateral wall 231 and the second lateral wall 232 abut against upper portions of two opposite side surfaces of the other first fastening block 121, respectively. The third abutting surfaces 253 of the first bottom wall 251 and the second bottom wall 252 abut against lower portions of the two opposite side surfaces of the one of the two first fastening blocks 121, respectively. The sixth abutting surfaces 254 of the first bottom wall 251 and the second bottom wall 252 abut against lower portions of the two opposite side surfaces of the other first fastening block 121, respectively.

The two second fastening blocks 122 are clamped between upper portions of the first lateral wall 231 and the second lateral wall 232, respectively. Upper portions of the two first abutting surfaces 234 of the first lateral wall 231 and the second lateral wall 232 abut against two opposite side surfaces of one of the two second fastening blocks 122, respectively. Upper portions of the two fourth abutting surfaces 235 of the first lateral wall 231 and the second lateral wall 232 abut against two opposite side surfaces of the other second fastening block 122, respectively.

The two third fastening blocks 123 are clamped between the first inner wall 241 and the second inner wall 242. The two second abutting surfaces 244 of the first inner wall 241 and the second inner wall 242 abut against two opposite side surfaces of one of the two third fastening blocks 123, respectively. The two fifth abutting surfaces 245 of the first inner wall 241 and the second inner wall 242 abut against two opposite side surfaces of the other third fastening block 123, respectively. The two fastening pieces 15 project beyond a top surface of the lateral wall 23. One of the two insertion portions 27 is located between one side of the one of the two fastening pieces 15 and one side of the other fastening piece 15. The other insertion portion 27 is located between the other side of the one of the two fastening pieces 15 and the other side of the other fastening piece 15.

As described above, the fastening portion 11 of the insulating housing 10 is fastened in the fastening slot 26 of the terminal 20, so the insulating housing 10 is without being scratched in the process of the insulating housing 10 being fastened in the terminal 20, so the plug connector 100 is capable of satisfying a high-demanding appearance standard.

What is claimed is:

1. A plug connector, comprising:

an insulating housing having an annular fastening portion, two opposite sides of a top of the fastening portion protruding upward and being arched outward to form two spaced arc-shaped fastening pieces; and a terminal surrounding the insulating housing, the terminal having a substantially annular lateral wall, a substantially annular inner wall located inside and spaced from the lateral wall, and a substantially annular bottom wall connected between bottoms of the lateral wall and the inner wall, a substantially annular fastening slot being formed among the lateral wall, the inner wall and the bottom wall, two portions of a top surface of the lateral wall protruding upward to form two insertion portions spaced from each other, the fastening portion being fastened in the fastening slot, one of the two insertion portions being located between one side of one of the two fastening pieces and one side of the other fastening piece, the other insertion portion being located between the other side of the one of the two fastening pieces and the other side of the other fastening piece.

2. The plug connector as claimed in claim 1, wherein the fastening portion has an annular base portion, a middle of an outer surface of the base portion protrudes outward away from a center of the base portion to form a ring-shaped fixing rib, an inner surface of the lateral wall is recessed in a direction away from a center of the terminal to form a substantially ring-shaped fixing slot, the fixing rib is fixed in the fixing slot.

3. The plug connector as claimed in claim 1, wherein the fastening portion has an annular base portion, an inner surface of the base portion protrudes inward towards a center of the base portion and then extends downward to form a ring-shaped restricting block connected with a bottom edge of the base portion, an outer surface of the inner wall is recessed inward towards a center of the terminal to form a substantially ring-shaped restricting slot, the restricting block is restricted in the restricting slot.

4. The plug connector as claimed in claim 1, wherein the insulating housing is integrally molded in the terminal positioned in a cavity of a mold, a gap between an inner surface of the cavity of the mold and an outer surface of the plug connector is 0.02 mm.

5. The plug connector as claimed in claim 1, wherein two opposite sides of the fastening portion are connected with two half-surrounded fastening blocks, respectively, the terminal includes a first semicircular portion and a second semicircular portion assembled to two opposite sides of the insulating housing, respectively, the first semicircular portion and the second semicircular portion face each other and are shown as a substantially annular shape, the two fastening blocks are clamped between the first semicircular portion and the second semicircular portion.

6. The plug connector as claimed in claim 5, wherein two end surfaces of each of the first semicircular portion and the second semicircular portion are defined as a first truncation surface and a second truncation surface, respectively, the two first truncation surfaces of the first semicircular portion and the second semicircular portion abut against two opposite surfaces of one of the two fastening blocks, respectively, the two second truncation surfaces of the first semicircular portion and the second semicircular portion abut against two opposite surfaces of the other fastening block, respectively.

7. The plug connector as claimed in claim 5, wherein each of the two fastening blocks includes a first fastening block, outer peripheries of the two opposite sides of the fastening portion protrude outward to form two first fastening blocks of the two fastening blocks, respectively, the first semicircular portion has a semicircular first lateral wall and a semicircular first bottom wall, the second semicircular portion has a semicircular second lateral wall and a semicircular second bottom wall, upper portions of the two first fastening blocks are clamped between lower portions of the first lateral wall and the second lateral wall, respectively, lower portions of the two first fastening blocks are clamped between the first bottom wall and the second bottom wall, respectively.

8. The plug connector as claimed in claim 7, wherein the two insertion portions are protruded upward from top surfaces of the first lateral wall of the first semicircular portion and the second lateral wall of the second semicircular portion, respectively.

9. The plug connector as claimed in claim 7, wherein each of the two fastening blocks includes a second fastening block, the two opposite sides of the top of the fastening portion protrude upward and outward to form two second fastening blocks of the two fastening blocks, respectively, the two second fastening blocks are clamped between upper portions of the first lateral wall and the second lateral wall, respectively.

10. The plug connector as claimed in claim 9, wherein one of the two second fastening blocks is located between the two fastening pieces and adjacent to the one of the two fastening pieces, the other second fastening block is located between the two fastening pieces and adjacent to the other fastening piece.

11. The plug connector as claimed in claim 9, wherein a top of each of the two second fastening blocks is recessed downward to form a recess.

12. The plug connector as claimed in claim 7, wherein each of the two fastening blocks includes a third fastening block, lower ends of the first fastening blocks are bent upward and connected with an inner surface of the fastening portion to form two third fastening blocks of the two fastening blocks, respectively, the first semicircular portion has a semicircular first inner wall, the second semicircular portion has a semicircular second inner wall, the two third fastening blocks are clamped between the first inner wall and the second inner wall.

13. The plug connector as claimed in claim 12, wherein the semicircular first inner wall is located inside and spaced from the first lateral wall, the semicircular first bottom wall is connected between bottoms of the first lateral wall and the first inner wall, a semicircular first fastening slot is formed among the first lateral wall, the first inner wall and the first bottom wall, the semicircular second inner wall is located inside and spaced from the second lateral wall, the semicircular second bottom wall is connected between bottoms of the second lateral wall and the second inner wall, a semicircular second fastening slot is formed among the second lateral wall, the second inner wall and the second bottom wall, the fastening slot includes the first fastening slot and the second fastening slot.

14. The plug connector as claimed in claim 13, wherein the lateral wall includes the first lateral wall and the second lateral wall, the inner wall includes the first inner wall and the second inner wall, the bottom wall includes the first bottom wall and the second bottom wall.

15. A terminal applied to a plug connector, the terminal including a first semicircular portion and a second semicircular portion facing each other and shown as a substantially annular shape, the terminal comprising:

a substantially annular lateral wall;

a substantially annular inner wall located inside and spaced from the lateral wall; and a substantially annular bottom wall connected between bottoms of the lateral wall and the inner wall, a substantially annular fastening slot being formed among the lateral wall, the inner wall and the bottom wall, two insertion portions being protruded upward from top surfaces of a first lateral wall of the first semicircular portion and a second lateral wall of the second semicircular portion, respectively;

wherein the plug connector includes an insulating housing, the terminal surrounds the insulating housing, wherein an inner surface of the lateral wall is recessed in a direction away from a center of the terminal to form a substantially ring-shaped fixing slot, the insulating housing has an annular fastening portion which has an annular base portion, a middle of an outer surface of the base portion protrudes outward away from a center of the base portion to form a ring-shaped fixing rib, the fixing rib is fixed in the fixing slot.

16. The terminal as claimed in claim 15, wherein an outer surface of the inner wall is recessed inward towards a center of the terminal to form a substantially ring-shaped restricting slot, the insulating housing has an annular fastening portion which has an annular base portion, an inner surface of the base portion protrudes inward towards a center of the base portion and then extends downward to form a ring-shaped restricting block connected with a bottom edge of the base portion, the restricting block is restricted in the restricting slot.

* * * * *